US010023991B2

(12) United States Patent
Kim et al.

(10) Patent No.: US 10,023,991 B2
(45) Date of Patent: Jul. 17, 2018

(54) WASHING MACHINE

(71) Applicant: SAMSUNG ELECTRONICS CO., LTD., Suwon-si, Gyeonggi-do (KR)

(72) Inventors: Young Hyun Kim, Suwon-si (KR); Dae Gyu Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 674 days.

(21) Appl. No.: 14/325,963

(22) Filed: Jul. 8, 2014

(65) Prior Publication Data

US 2015/0013397 A1 Jan. 15, 2015

(30) Foreign Application Priority Data

Jul. 9, 2013 (KR) ..... 10-2013-0080083

(51) Int. Cl.

| | |
|---|---|
| ***D06F 39/08*** | (2006.01) |
| ***D06F 37/24*** | (2006.01) |
| ***D06F 39/10*** | (2006.01) |
| *D06F 39/12* | (2006.01) |
| *D06F 23/04* | (2006.01) |
| *D06F 37/26* | (2006.01) |

(52) U.S. Cl.

CPC ..... *D06F 39/088* (2013.01); *D06F 23/04* (2013.01); *D06F 37/245* (2013.01); *D06F 37/267* (2013.01); *D06F 39/083* (2013.01); *D06F 39/10* (2013.01); *D06F 39/125* (2013.01)

(58) Field of Classification Search

CPC ..... D06F 39/083; D06F 39/10; D06F 39/125; D06F 39/088; D06F 37/245; D06F 37/267; D06F 23/04

USPC ..... 68/207, 18 F; 134/111

See application file for complete search history.

(56) References Cited

U.S. PATENT DOCUMENTS 3,774,418 A * 11/1973 Ohmann ..... D06F 39/10 210/136
3,798,932 A * 3/1974 Tromblee ..... D06F 39/02 134/93
4,039,452 A * 8/1977 Fernandez ..... B01D 29/05 210/106

* cited by examiner

*Primary Examiner* — Michael E Barr
*Assistant Examiner* — Tinsae B Ayalew
(74) *Attorney, Agent, or Firm* — Staas & Halsey LLP

(57) ABSTRACT

A washing machine including a filter device, a support, or an auxiliary damper, using pressure of water supplied thereto. The washing machine includes a casing, a reservoir installed inside the casing, a water supply tube connected to an upper portion of the reservoir such that wash water is supplied through the water supply tube, a drainage tube connected to a lower portion of the reservoir such that wash water is discharged through the drainage tube, and a filter device which allows wash water to be moved and eliminates foreign substances from the wash water at one side of the reservoir using pressure of the wash water supplied through the water supply tube. It may be possible to eliminate foreign substances from laundry using pressure of water supplied according to progress of operation of the washing machine without provision of additional power.

13 Claims, 7 Drawing Sheets

WASHING MACHINE

CROSS-REFERENCE TO RELATED APPLICATIONS

This application claims the benefit of Korean Patent Application No. 10-2013-0080083, filed on Jul. 9, 2013 in the Korean Intellectual Property Office, the disclosure of which is incorporated herein by reference.

BACKGROUND

1. Field

Embodiments of the present disclosure relate to a washing machine including a filter device, a support, or an auxiliary damper, using pressure of water supplied thereto.

2. Description of the Related Art

A washing machine is an apparatus which agitates laundry and wash water to wash the laundry. Washing machines are classified into a horizontal axis washing machine and a vertical axis washing machine. The horizontal axis washing machine washes laundry by tumbling the laundry along an inner peripheral surface of a rotary tub when the horizontally arranged rotary tub rotates about a horizontal axis thereof in forward and backward directions. The vertical axis washing machine includes a pulsator therein and washes laundry using a water stream produced by the pulsator.

Foreign substances such as lint or residues occur in the process of washing laundry. A washing machine includes a filter device in order to prevent failure of the washing machine due to infiltration of such foreign substances. An existing filter device mainly utilizes a method in which wash water is lifted up by means of driving a pulsator and then returns back to a reservoir through a filter. However, such a method has problems in that lifting up wash water consumes energy owing to fluid resistance and washing capacity is wasted due to formation of blades for production of a water stream in the pulsator or the like. In addition, there is the inconvenience of having to replace or clean the filter device in order to eliminate the filtered foreign substances.

In addition, there are problems in that a support by which a washing machine rests on the floor has to be installed as an additional device and a structure of manually operating the support is difficult to adjust the balance of the washing machine.

An existing washing machine is provided with a vibration device as means of damping vibration of a rotating rotary tub. However, since the vibration device is attached to only a lower portion of the rotary tub, vibration may not be efficiently attenuated.

SUMMARY

Therefore, it is an aspect of the present disclosure to provide a washing machine including a filter device to filter foreign substances from wash water by means of using pressure of water supplied thereto and a washing process via which supplementary water are additionally supplied.

It is another aspect of the present disclosure to provide a washing machine including a support to support the washing machine or an auxiliary damper to attenuate vibration, by means of using pressure of water supplied thereto.

Additional aspects of the disclosure will be set forth in part in the description which follows and, in part, will be apparent from the description, or may be learned by practice of the disclosure.

In accordance with one aspect of the present disclosure, a washing machine includes a casing, a reservoir installed inside the casing, a water supply tube connected to an upper portion of the reservoir such that wash water is supplied through the water supply tube, a drainage tube connected to a lower portion of the reservoir such that wash water is discharged through the drainage tube, and a filter device vertically elongated in a surplus space between the casing and the reservoir, so as to move wash water and to eliminate foreign substances from the wash water using pressure of the wash water supplied through the water supply tube.

The filter device may include a main body which is provided at both sides thereof with a first opening and a second opening, the first opening may be connected through a connection tube to the water supply tube, and the second opening located opposite to the first opening may be connected to the reservoir and the drainage tube.

The filter device may include a moving device movably installed therein.

The moving device may include a closure to block an inner portion of the filter device, and the moving device may move in the inner portion of the filter device by pressure of wash water supplied through the connection tube and pressure of wash water filling the reservoir.

The moving device may include an elastic portion which is compressible or expandable.

The water supply tube may include a water supply valve through which wash water is capable of being supplied to the reservoir or blocked from being supplied to the reservoir.

The second opening may be connected to the reservoir and a first passage while being connected to the drainage tube and a second passage, and the second opening may be provided with a check valve to close the first passage such that wash water introduced into the filter device is capable of being discharged through the second passage.

The check valve may be installed so as to be shiftable to the second passage such that wash water in the reservoir is capable of being introduced into the filter device.

The drainage tube may be provided, at one side thereof, with the second passage connected to the filter device while being provided, at the other side thereof, with a drainage valve through which wash water is capable of being discharged to the outside or blocked from being discharged to the outside.

The drainage tube may include a third passage connected to the reservoir, and the third passage may include a filter to filter foreign substances from wash water.

The foreign substances filtered by the filter may be discharged to the outside along with wash water discharged through the drainage valve to the outside.

In accordance with another aspect of the present disclosure, a washing machine includes a reservoir connected, at an upper portion thereof, to a water supply tube through which wash water is supplied while being connected, at a lower portion thereof, to a drainage tube through which wash water is discharged, so as to accommodate wash water, and a filter device to eliminate foreign substances from the wash water accommodated in the reservoir, wherein the filter device includes a connection tube connected to the water supply tube so as to introduce wash water, and a moving device movably installed inside the filter device by wash water, and the wash water accommodated in the reservoir circulates through the drainage tube and the reservoir and passes through a filter located between the drainage tube and the reservoir, according to movement of the moving device, so as to eliminate foreign substances.

The filter device may be elongated on one side surface of the reservoir in a longitudinal direction thereof, the filter device being provided, at upper and lower portions thereof, with a first opening and a second opening, the first opening located at the upper portion of the filter device may be connected to the water supply tube such that wash water is supplied through the first opening, and the second opening located at the lower portion of the filter device may be connected to the drainage tube and the lower portion of the reservoir.

The water supply tube may include the connection tube through which wash water is discharged to the first opening and a water supply valve through which wash water is capable of being introduced into the reservoir or blocked from being introduced into the reservoir, and the connection tube and the water supply valve may be sequentially arranged in an introduction direction of wash water such that wash water is capable of being introduced into only the connection tube and the moving device is capable of dropping when the water supply valve is closed.

The second opening may be connected to the lower portion of the reservoir and a first passage while being connected to the drainage tube and a second passage, and the second opening may be provided with a check valve which is fixed between the first passage and the second passage so as to close the first passage.

The check valve may be installed such that wash water is capable of being introduced into the filter device by opening the first passage using pressure of wash water filling the reservoir and the check valve may allow the first passage to be closed such that the wash water introduced into the filter device is capable of being discharged through the second passage.

The drainage tube may include a drainage valve through which wash water is discharged to the outside or is blocked from being discharged to the outside and a third passage connected to the lower portion of the reservoir, the third passage may include a filter configured such that foreign substances contained in wash water, which is discharged through the second passage and introduced into the drainage tube, remain in the drainage tube while the wash water passes through the filter, and the foreign substances remaining in the drainage tube may be discharged to the outside along with wash water discharged to the outside by opening of the drainage valve.

The moving device may be made of an elastic material such that the moving device is contractible or expandable by water pressure so as to be balanced.

In accordance with another aspect of the present disclosure, a washing machine includes a casing, a reservoir installed inside the casing to accommodate wash water, a water supply tube provided at an upper portion of the reservoir such that wash water is supplied through the water supply tube, and a support located at a bottom of the casing so as to balance the casing using pressure of wash water supplied through the water supply tube.

The support may be provided in plural number in the form of a piston movable by water pressure at the bottom of the casing.

At least one of the plural supports may be connected to the water supply tube, and the plural supports may be joined to at least one other support.

The support may include a first support and a second support, the first support may be connected to a first water passage which is vertically elongated from the water supply tube in a longitudinal direction inside the casing, the first and second supports may be connected to a second water passage located inside the casing, and the second water passage may include a valve through which fluid is capable of passing or being blocked.

Fluid introduced into the first water passage may pass through the first support and the second water passage and flow into the second support, and the valve may allow fluid to pass or be blocked such that the first and second supports are capable of adjusting balance of the casing.

In accordance with a further aspect of the present disclosure, a washing machine includes a casing defining an external appearance thereof, a reservoir installed inside the casing to accommodate wash water, a rotary tub rotatably installed inside the reservoir, a water supply tube connected to an upper portion of the reservoir such that wash water is supplied through the water supply tube, a damper device including a support rod, which connects the reservoir and the casing such that the reservoir is capable of being supported by the casing, and a damping spring attached to a lower portion of the support rod so as to attenuate oscillation of the reservoir, and an auxiliary damper located between the support rod and the reservoir, so as to attenuate oscillation of the reservoir using pressure of wash water supplied through the water supply tube.

The auxiliary damper may be located between an upper portion of the support rod and the reservoir and may include a piston movable by pressure of water supplied to a connection tube connected to the water supply tube.

Wash water introduced from the water supply tube may flow into the auxiliary damper through the connection tube, and the piston attached to the rotary tub may attenuate vibration of the rotary tub by moving according to the vibration thereof.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
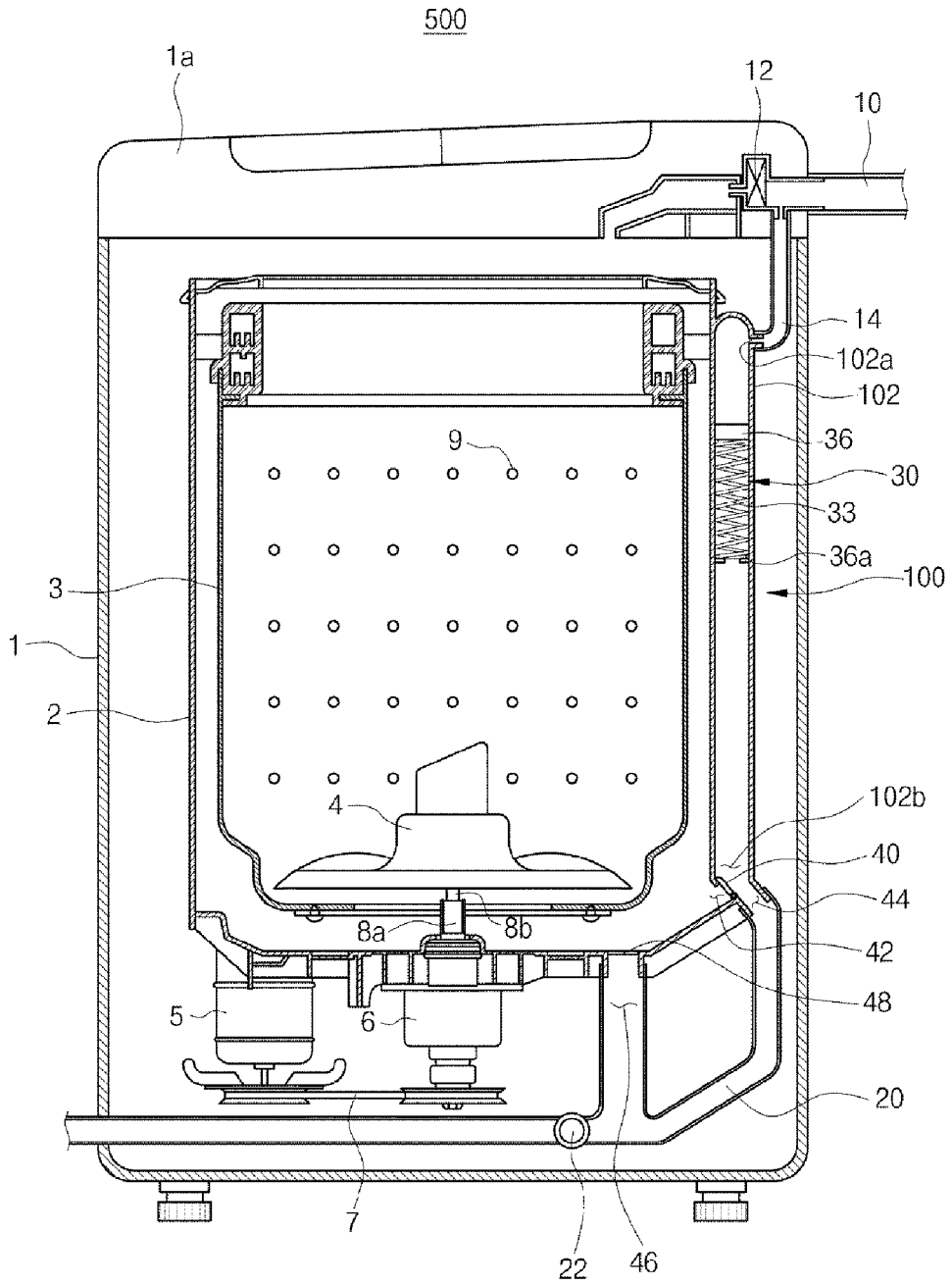
FIG. 1 is a diagram illustrating a washing machine and a filter device attached thereto according to an embodiment of the present disclosure.

Reference will now be made in detail to the embodiments of the present disclosure, examples of which are illustrated in the accompanying drawings, wherein like reference numerals refer to like elements throughout.

Figure 2:
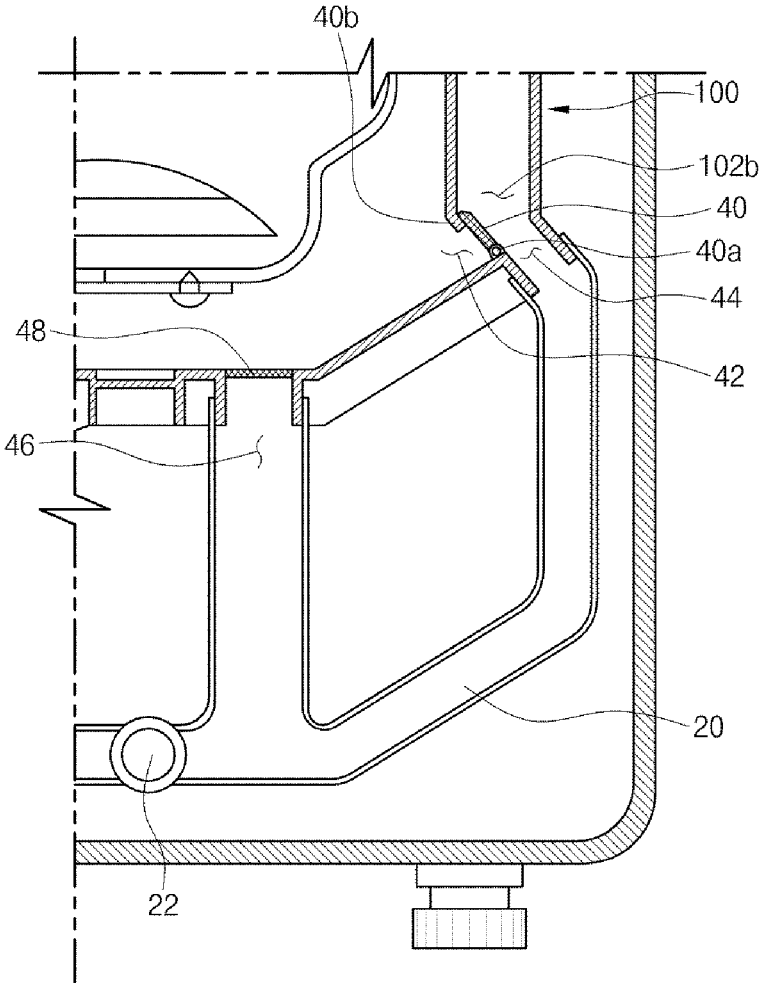
FIG. 2 is an enlarged view illustrating a lower portion of the washing machine and the filter device attached thereto in FIG. 1.

FIG. 1 is a diagram illustrating a washing machine 500 and a filter device 100 attached thereto according to an embodiment of the present disclosure. FIG. 2 is an enlarged view illustrating a lower portion of the washing machine 500 and the filter device 100 attached thereto in FIG. 1.

The washing machine 500 includes a casing 1 defining an external appearance thereof and a reservoir 2 installed inside the casing 1 to accommodate wash water. The washing machine 500 also includes a rotary tub 3 rotatably installed inside the reservoir 2 and a pulsator 4 installed at a lower side within the rotary tub 3 to produce a washing water stream. The washing machine 500 also includes a drive motor 5 and a clutch device 6, which are provided beneath the reservoir 2, to drive the rotary tub 3 and the pulsator 4.

The casing 1 is provided, at an upper portion thereof, with a cover 1*a* covering an opened upper portion of the casing 1 and a control panel to control operation of the washing machine. Laundry may be inserted into or withdrawn from the casing 1 in a state of opening the cover 1*a*.

The casing 1 is provided, at one side of the upper portion thereof, with a water supply device including a water supply tube 10 and a water supply valve 12 through which wash water is supplied to the reservoir 2. The casing 1 is provided, at one side of the lower portion thereof, with a drainage device including a drainage tube 20 and a drainage valve 22 through which the wash water filling the reservoir 2 is discharged to the outside.

The reservoir 2 may be installed at a center within the casing 1 so as to operate stably. The reservoir 2 may have a cylindrical structure capable of accommodating wash water. An upper portion of the reservoir 2 is opened and connected to the water supply tube 10 so that wash water may be supplied to the reservoir 2. A lower portion of the reservoir 2 is connected to the drainage tube 20 so that the wash water accommodated in the reservoir 2 may be discharged to the outside.

The rotary tub 3 is installed at a center of the reservoir 2 so as to be stably rotatable. The rotary tub 3 has a plurality of through-holes 9 through which an inner space of the rotary tub 3 communicates with an inner space of the reservoir 2. That is, laundry is placed inside the rotary tub 3 and wash water is simultaneously accommodated in both of the rotary tub 3 and the reservoir 2 through the through-holes 9. The rotary tub 3 is opened at an upper portion thereof so that wash water and laundry may be accommodated in the rotary tub 3. The rotary tub 3 may be coupled, at a lower portion thereof, to a dehydration shaft 8*a* connected to the clutch device 6.

The pulsator 4 may be installed at the lower side within the rotary tub 3 in order to produce a washing water stream. That is, the pulsator 4 may agitate laundry placed in the rotary tub 3 along with wash water. The pulsator 4 is supported by a wash shaft 8*b* and is rotatably installed at a lower center of the rotary tub 3.

The drive motor 5 is coupled to a lower portion outside the reservoir 2. The clutch device 6, to which power is transmitted from the drive motor 5, is installed at a center of the lower portion outside the reservoir 2. The drive motor 5 and the clutch device 6 are connected by a drive belt 7 and the drive motor 5 transmits power to the clutch device 6 therethrough. The clutch device 6 may selectively rotate the dehydration shaft 8*a* and the wash shaft 8*b*. In addition, the clutch device 6 may reduce the rate of rotation of the pulsator 4 and may perform a braking function to stop rotation of the rotary tub 3.

Hereinafter, an overall washing process of the washing machine 500 will be described together with operation of components thereof. First, laundry is accommodated in the rotary tub 3 and wash water is supplied through the water supply tube 10 to the reservoir 2 along with detergent. Next, drive force of the drive motor 5 is transmitted through the clutch device 6 to the wash shaft 8*b* to thereby rotate the pulsator 4. Washing is performed while laundry in the rotary tub 3 is agitated with wash water by rotation of the pulsator 4.

In order to retain wash water to a proper level during washing, supplementary water is introduced through the water supply tube 10. The supplementary water may be supplied several times for smooth washing.

When washing is completed, the wash water filling the reservoir 2 is discharged through the drainage tube 20 to the outside. The wet laundry remains in the rotary tub 3 when the wash water is discharged and then dehydration is performed. Moisture is removed from the laundry by centrifugal force while the rotary tub 3 rotates by transmission of drive force of the drive motor 5 through the clutch device 6 to the dehydration shaft 8*a*.

In such a washing process, foreign substances are eliminated from the laundry and the foreign substances float in wash water. Hereinafter, a description will be given of a filter device 100 to eliminate foreign substances floating in wash water. The filter device 100 may be located in a surplus space defined between the casing 1 and the reservoir 2.

The filter device 100 may include a main body 102 which is provided at both sides thereof with a first opening 102*a* and a second opening 102*b* and has a space therein. The first opening 102*a* may be connected to the water supply tube 10 to supply water into the main body 102. The second opening 102*b* is connected to the drainage tube 20 and the reservoir 2. The main body 102 may be vertically elongated so as to have the first opening 102*a* at an upper portion thereof and the second opening 102*b* at a lower portion thereof.

The first opening 102*a* may be connected through a connection tube 14 to one side of the water supply tube 10. The water supply tube 10 may be installed such that water is capable of being supplied from the outside of the washing machine 500 to the reservoir 2 and may include the water supply valve 12 capable of adjusting the supplied water. The connection tube 14 may be located farther upstream than the water supply valve 12 such that water supplied through the water supply tube 10 flows in serial order of the connection tube 14 and the water supply valve 12. That is, the connection tube 14 and the water supply valve 12 may be sequentially arranged in the water supply tube 10 in an introduction direction of wash water. Accordingly, water may be supplied to both of the connection tube 14 and the reservoir 2 when the water supply valve 12 is opened, whereas water may be supplied to only the connection tube 14 when the water supply valve 12 is closed.

The filter device 100 may include a moving device 30 movably installed inside the main body 102. The moving device 30 may include a closure 36 to block an inner portion of the main body 102, an elastic portion 33 which is compressible or expandable, and a plug 36*a* having an opening. The moving device 30 may move vertically along the inner portion of the vertically elongated main body 102. The moving device 30 includes the closure 36 so as to be moved by pressure of water introduced into the main body 102. Water may not flow through the inner portion of the main body 102 because of the closure 36. That is, due to the moving device 30, water supplied through the first opening 102*a* of the main body 102 may not be discharged through the second opening 102*b* and wash water introduced through the second opening 102*b* may also not be discharged through the first opening 102*a*. The moving device 30 may include the elastic portion 33 which is compressible or expandable by water pressure. The plug 36*a* having the opening provided in the moving device 30 may support the elastic portion 33 and may help the moving device 30 in being contractible or expandable depending upon water pressure or air pressure.

The second opening 102*b* may be connected to the reservoir and a first passage 42 while being connected to the drainage tube 20 and a second passage 44. A check valve 40 is arranged between the second opening 102*b* and the first passage 42. As shown in FIG. 3, the check valve 40 may be fixed, at one side thereof, to a fixed portion 40*a* located between the first passage 42 and the second passage 44.

The filter device 100 attached to one side of the reservoir 2 may share an outer wall of the reservoir 2. The outer wall defining the first passage 42 may have, at a tip thereof, a portion 40*b* which is slightly bent toward the filter device 100. The other unfixed side of the check valve 40 may be seated on such a bent portion 40*b*.

The check valve 40 may open the first passage 42 and shift to the second passage 44 by pressure of wash water placed in the reservoir 2. The moved check valve 40 may close the second passage 44 so as to prevent wash water from being discharged to the drainage tube 20. As pressure of water in the reservoir 2 is decreased, the check valve 40 may return back to close the first passage 42.

The drainage tube 20 connected to the second passage 44 includes the drainage valve 22 to discharge or block wash water. The drainage tube 20 leads from the second passage 44 to the bottom of the reservoir 2 and is connected to the outside. The drainage tube 20 includes a third passage 46 which is connected at one side thereof to the lower portion of the reservoir 2. The third passage 46 may be provided with a filter 48 capable of filtering out foreign substances. Wash water is introduced into the reservoir 2 through the third passage 46 in the drainage tube 20, and foreign substances contained in the wash water remain in the drainage tube 20. The foreign substances remaining in the drainage tube 20 may be discharged to the outside along with the wash water by opening the drainage valve 22.

Figure 3A:
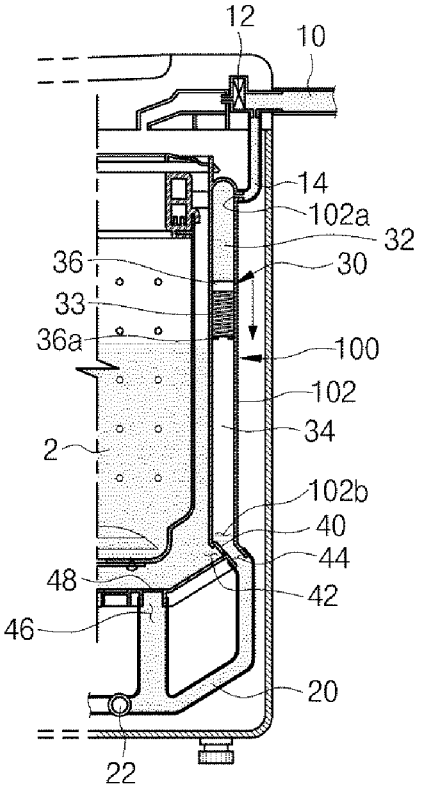
FIGS. 3A, 3B, and 3C are diagrams illustrating operation of the filter device in the washing machine according to the embodiment of the present disclosure.
Figure 3B:
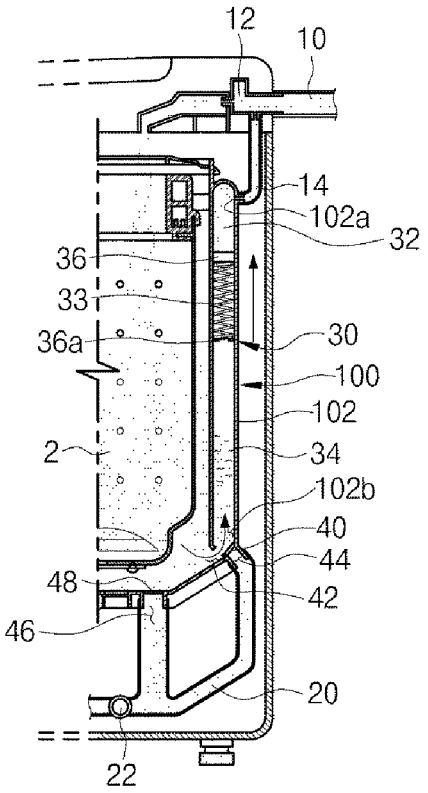
Figure 3C:
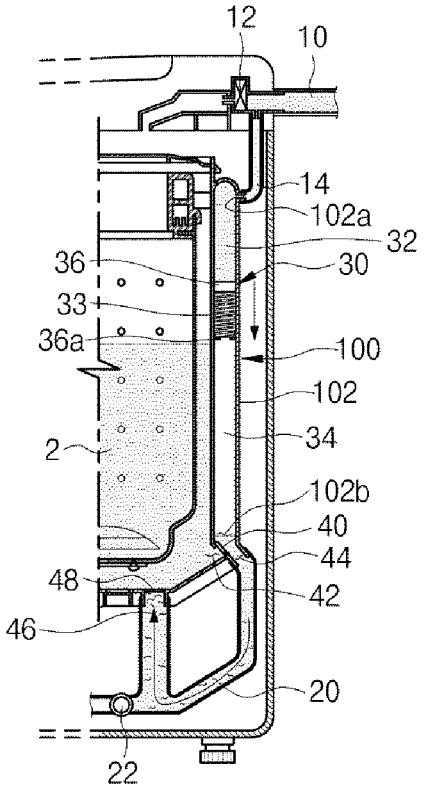

FIGS. 3A, 3B, and 3C are diagrams illustrating operation of the filter device 100 in the washing machine 500 according to the embodiment of the present disclosure.

The main body 102 is divided into an upper portion 32 and a lower portion 34 by the closure 36 of the moving device 30 hindering flow of fluid. The magnitude of the upper portion 32 and the lower portion 34 may vary as the moving device 30 moves vertically.

When a washing process begins, water is supplied from the water supply tube 10. The supplied water flowing through the water supply tube 10 passes through the connection tube 14 and is introduced into the filter device 100, thereby enabling the upper portion 32 of the main body 102 to be filled with water. The supplied water passes through the opened water supply valve 12 and fills the reservoir 2. Wash water is not introduced into the lower portion 34 of the main body 102 by pressure of the moving device 30 due to air filling the lower portion 34 of the main body 102 and water filling the upper portion 32.

As shown in FIG. 3A, water is not supplied to the reservoir 2 when the water supply valve 12 is closed. The pressure of the upper portion 32 is increased as water is supplied to only the filter device 100 along the connection tube 14, thereby enabling the moving device 30 to contract and drop. The air filling the lower portion 34 may be discharged to the outside by the pressure of the moving device 30. Only a small remaining amount of air may be present in the lower portion 34 of the main body 102.

As shown in FIG. 3B, supplementary water may be introduced into the reservoir 2 when the water supply valve 12 is opened after a certain time. Water pressure is increased as wash water fills the reservoir 2, thereby enabling the check valve 40 to be opened by the pressure of the wash water filling the reservoir. Wash water may be introduced through the first passage 42 into the lower portion 34 of the main body 102. In this case, the check valve 40 shifts toward the second passage 44 so as to close the second passage 44 and prevent discharge of wash water. The moving device 30 may be raised by the pressure of the wash water introduced into the lower portion 34. The wash water introduced from the reservoir 2 may fill an increased space of the lower portion 34.

As shown in FIG. 3C, the water supply valve 12 is closed again after introduction of the supplementary water is completed and thus water is no longer supplied to the reservoir 2. As the pressure of the wash water filling the reservoir 2 is decreased, the check valve 40 shifts and closes the first passage 42 again. Water may continue to be supplied through the connection tube 14 to the upper portion 32 of the main body 102 and apply pressure to the moving device 30. While the moving device 30 moves downward by the pressure of the supplied water, the wash water filling the lower portion 34 may flow to the second passage 44. The wash water may not flow to the first passage 42 owing to the check valve 40. The wash water flowing to the second passage 44 receives pressure and moves along the drainage tube 20, thereby flowing to the third passage 46. The wash water may not be discharged to the outside due to closing of the drainage valve 22 and may be introduced through the third passage 46 into the reservoir 2. The wash water passing through the third passage 46 may be introduced into the reservoir 2 in a state in which foreign substances filtered from the wash water by the filter 48 remain in the drainage tube 20.

During washing, supplementary water is not introduced in a single stage, but is introduced several times. The moving device 30 may move vertically using pressure of the introduced water, and thus wash water may circulate through the drainage tube 20 and the reservoir 2. Repeating such a process allows foreign substances contained in wash water to be filtered out.

The foreign substances remaining in the drainage tube may be discharged to the outside when wash water is discharged after completion of washing operation. When wash water in the reservoir 2 flows to the outside along the drainage tube 20, the foreign substances remaining in the drainage tube 20 may be discharged therewith.

Figure 4:
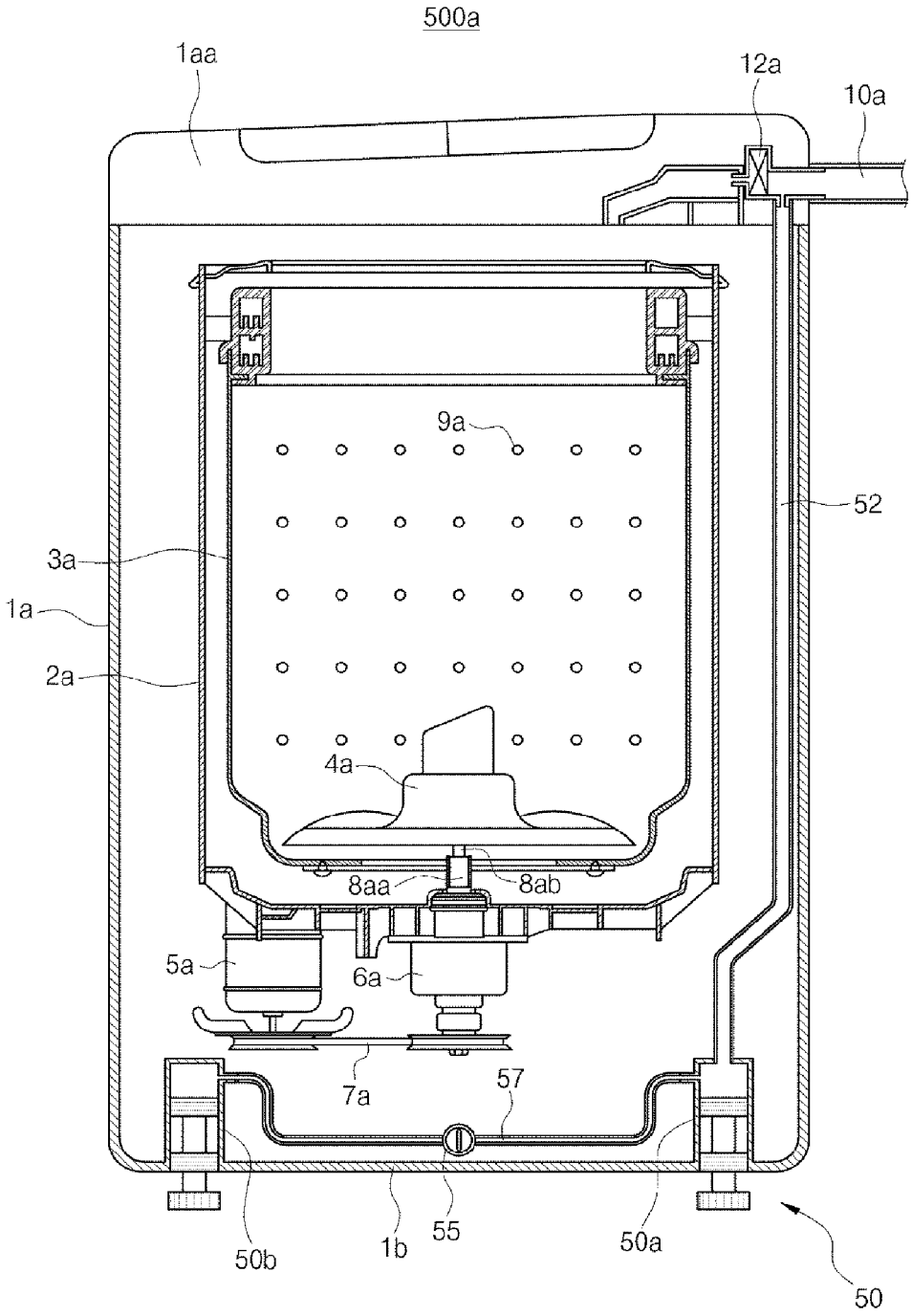
FIG. 4 is a diagram illustrating a washing machine and a support to support the same according to another embodiment of the present disclosure.

FIG. 4 is a diagram illustrating a washing machine 500*a* and a support 50 to support the washing machine 500*a* according to another embodiment of the present disclosure.

A casing 1*a* defining an external appearance of the washing machine 500*a* operates in a state in which a bottom 1*b* is located on the floor. Since a site at which the bottom 1*b* is located is different for each household, the washing machine 500*a* is provided with a support 50 to stably locate the washing machine 500*a*.

The support 50 may be provided in plural number at the bottom 1*b* of the casing 1*a* so as to stable fix the casing 1*a*. The support 50 may be located beneath a reservoir 2*a* arranged inside the casing 1*a* and a motor device 5*a* attached to a lower portion of the reservoir 2*a* and be located on the floor by penetrating the bottom 1*b* of the casing 1*a*.

The support 50 may be provided in the form of a piston movable by water pressure. At least one of the supports 50 may be connected to a water supply tube 10*a* located at an upper portion of the casing 1*a*. In addition, the supports 50 may be joined to at least one other support.

As shown in FIG. 4, the bottom 1*b* of the casing 1*a* may be provided with a first support 50*a* and a second support 50*b*. The first and second supports 50*a* and 50*b* may be spaced apart from each other by a proper distance such that the washing machine 500*a* may be stably located. Each support 50 may be located at a corner of the bottom 1*b* of the casing 1*a*.

The first support 50*a* may be provided, at one side thereof, with a first water passage 52 connected to the water supply tube 10*a*. The first water passage 52 may be elongated vertically along a surplus space between the reservoir 2*a* and the casing 1*a*. The first and second supports 50*a* and 50*b* may be connected to a second water passage 57. The second water passage 57 may be located horizontally along the bottom 1*b*. The second water passage 57 is provided with a valve 55 through which fluid is capable of passing or being blocked.

During washing operation, water supplied through the water supply tube 10*a* may flow through the first water passage 52 provided at one side of the water supply tube 10*a*. The water supplied toward the bottom 1*b* of the casing 1*a* along the vertically elongated first water passage 52 may be introduced into the first support 50*a*. The supplied water may fill the first support 50*a* and then flow along the second water passage 57 provided at one side of the first support 50*a*. The supplied water may pass through the opened valve 55 and be introduced into the second support 50*b* to fill the same.

Since the first and second supports 50*a* and 50*b* are connected to each other through the second water passage 57, pistons provided in the respective first and second supports 50*a* and 50*b* may be moved relative to each other by fluid pressure. Then, when the valve 55 is closed, water is no longer supplied to the second support 50*b*. Displacement of the first and second supports 50*a* and 50*b* filled with water is restricted by water pressure, thereby enabling the washing machine 500*a* to be balanced.

The supplied water may be adjusted to a proper level according to opening or closing of the valve 55. In addition, the support 50 may fast or slow adjust balance of the washing machine 500*a* depending upon an opening degree of the valve 55. Similar to the previous embodiments, washing machine 500*a* may also include a cover 1*aa*, rotary tub 3*a*, pulsator 4*a*, drive motor 5*a*, clutch device 6*a*, drive belt 7*a*, dehydration shaft 8*aa*, wash shaft 8*ab*, water supply valve 12*a*.

Figure 5:
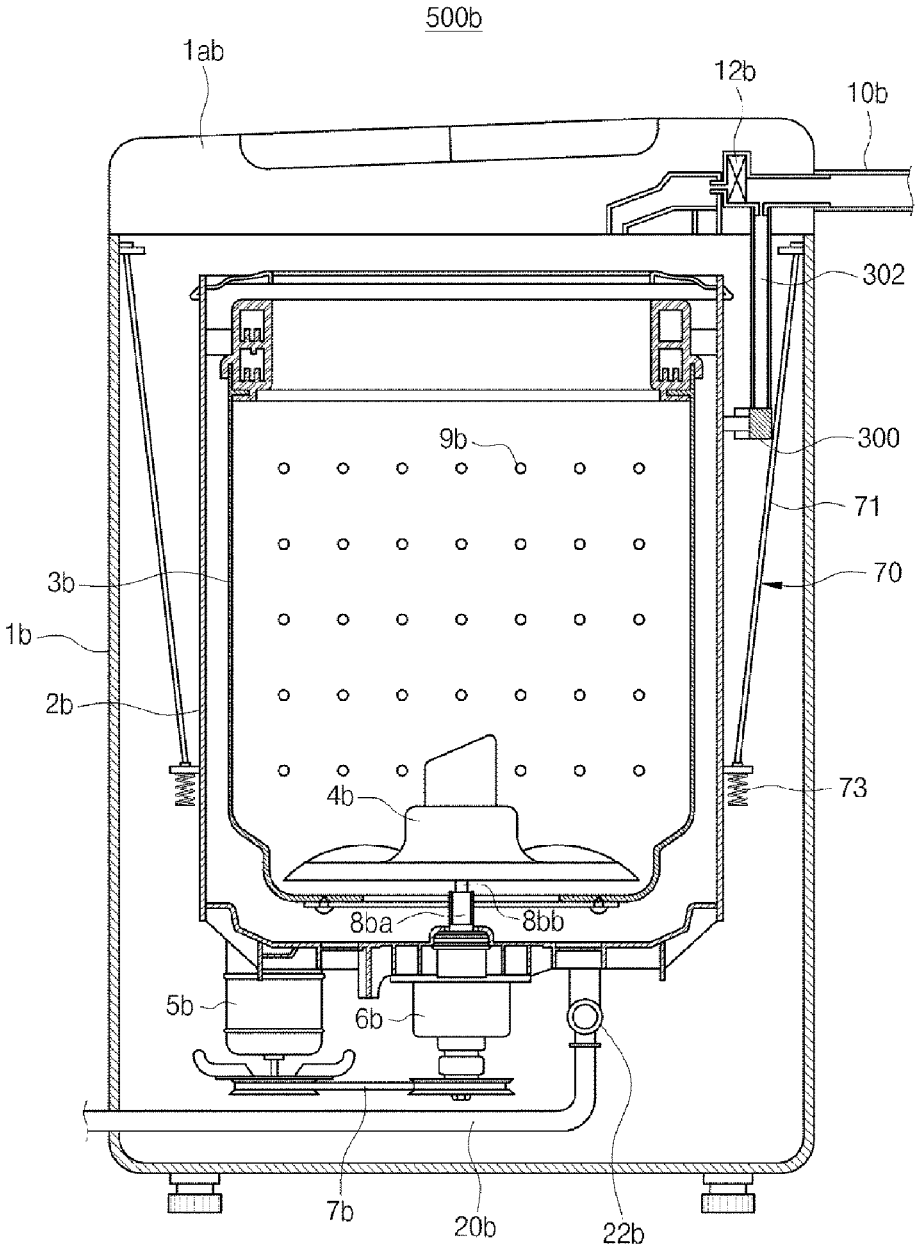
FIG. 5 is a diagram illustrating a washing machine and a damper device and an auxiliary damper installed thereto according to a further embodiment of the present disclosure.

FIG. 5 is a diagram illustrating a washing machine 500*b* and a damper device 70 and an auxiliary damper 300 installed thereto according to a further embodiment of the present disclosure.

When a pulsator 4*b* or a rotary tub 3*b* located within a reservoir 2*b* rotates during washing operation, vibration thereof may be transferred to the reservoir 2*b*. Particularly, when laundry is concentrated toward a part of the rotary tub 3*b* during dehydration in which the rotary tub 3*b* rotates at high speed, vibration of the rotary tub 3*b* may be transferred to the reservoir 2*b* while the rotary tub 3*b* rotates eccentrically. In order to attenuate such vibration and operate the washing machine in a state in which a casing 1*b* stably rests on the floor, a damper device 70 and an auxiliary damper 300 may be provided.

The damper device 70 includes a support rod 71 connecting the casing 1*b* and the reservoir 2*b* and a damping spring 73 coupled at a lower end portion of the support rod 71 to damp vibration of the reservoir 2*b*. The damper device 70 may be typically configured of four damper devices in order to support the reservoir 2*b* by hanging the reservoir 2*b* on the casing 1*b*. An upper end portion of the support rod 71 is coupled to an upper portion of the casing 1*b* and the lower end portion of the support rod 71 is provided with the damping spring 73.

The damping spring 73 may be accommodated in a cover and coupled to a lower outer side of the reservoir 2*b* by a bracket. The plural damping springs 73 coupled with the respective damper devices 70 may be arranged around the lower outer side of the reservoir 2*b* at a certain interval. The damping springs 73 allow vibration generated by the rotary tub 3*b* of the reservoir 2*b* during washing or dehydration to be attenuated.

In each damper device 70, the lower end of the support rod 71 is connected to one side of the lower portion of the reservoir 2*b* and the reservoir 2*b* is fixed in a state of being hung by the support rod 71. Accordingly, the unfixed upper portion of the reservoir 2*b* oscillates when the rotary tub 3*b* rotates eccentrically, resulting in generation of vibration and noise. Therefore, since the upper portion of the reservoir 2*b* may be fixed by installing the auxiliary damper 300 to the upper portion of the reservoir 2*b*, vibration may be attenuated.

The auxiliary damper 300 may be connected to a water supply tube 10*b* in order to use water supplied therefrom. The auxiliary damper 300 may be located between the upper portion of the support rod 71 and the reservoir 2*b*. The auxiliary damper 300 may be provided in the form of a piston movable by pressure of water supplied thereto.

The auxiliary damper 300 may be fixed to the upper portion of the support rod 71 such that one side tip of a piston may come into contact with the upper portion of the reservoir 2*b*. The piston may be moved by supply of water to a connection tube 302 provided at one side of the auxiliary damper 300. The auxiliary damper 300 may be installed horizontally in order for the piston to attenuate vibration of the rotary tub 3*b* rotating about a vertical axis thereof.

The connection tube 302 may be installed such that the connection tube 302 is connected to one side of the water supply tube 10*b* to supply water into the auxiliary damper 300. The supplied water may be received within the auxiliary damper 300 and attenuate vibration of the upper portion of the reservoir 2*b* using drag of fluid.

In this case, the auxiliary damper 300 and the damper device 70 may absorb vibration of the reservoir 2*b* and simultaneously support the reservoir 2*b* such that the reservoir 2*b* does not considerably oscillate. Therefore, the vibration transferred from the reservoir 2*b* is not easily transferred to the casing 1*b*.

In addition, since the auxiliary damper 300 supports the upper portion of the reservoir 2*b*, the reservoir 2*b* may not oscillate along with the rotary tub 3*b* because of not cooperating with oscillation of the rotary tub 3*b*. Therefore, since an eccentric rotation width of the rotary tub 3*b* is not increased, overall vibration and noise when the washing machine operates may be reduced. Similar to the previous embodiments, washing machine 500*b* also includes a cover 1*ab*, drive motor 5*b*, clutch device 6*b*, drive belt 7*b*, dehydration shaft 8*ba*, wash shaft, 8*bb*, water valve 12*b*, drainage tube 20*b* and drainage valve 22*b*.

As is apparent from the above description, it may be possible to eliminate foreign substances from laundry using pressure of water supplied according to progress of operation of a washing machine without provision of additional power. In addition, since the foreign substances may be discharged along with drainage, a filter device need not be replaced or cleaned separately.

In addition, it may be possible to provide a washing machine equipped with a support capable of adjusting balance of the washing machine by means of using pressure of water supplied to the support. Furthermore, it may be possible to provide a washing machine equipped with an auxiliary damper to attenuate vibration due to rotation by means of using pressure of water supplied thereto.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a casing;

a reservoir installed inside the casing;

a water supply tube connected to an upper portion of the reservoir such that wash water is supplied through the water supply tube;

a drainage tube connected to a lower portion of the reservoir such that wash water is discharged through the drainage tube; and a filter device arranged between the casing and the reservoir to move wash water and to eliminate foreign substances from the wash water using pressure of the wash water supplied through the water supply tube, wherein the filter device comprises a main body which is provided at both sides thereof with a first opening and a second opening;

the first opening is connected through a connection tube to the water supply tube;

the second opening located opposite to the first opening is connected to the reservoir through a first passage and the drainage tube through a second passage;

a check valve configured to selectively open and close the first passage and the second passage; and a moving device movably installed between the first opening and the second opening, wherein the moving device moves in an inner portion of the main body by pressure of wash water supplied through the connection tube and pressure of wash water filling the reservoir, when the moving device is moved downward by pressure of the wash water supplied through the water supply tube, the check valve opens the second passage and closes the first passage, and when the moving device is moved up, the check valve opens the first passage and closes the second passage.

2. The washing machine according to claim 1, wherein the moving device comprises an elastic portion which is compressible and expandable.

3. The washing machine according to claim 1, wherein the water supply tube comprises a water supply valve through which wash water is capable of being supplied to the reservoir or blocked from being supplied to the reservoir.

4. The washing machine according to claim 1, wherein the check valve is installed to be shiftable to the second passage such that wash water in the reservoir is introduced into the main body.

5. The washing machine according to claim 4, wherein the drainage tube is provided, at one side thereof, with the second passage connected to the main body while being provided, at the other side thereof, with a drainage valve through which wash water is discharged to the outside or blocked from being discharged to the outside.

6. The washing machine according to claim 1, wherein the filter device is formed integrally with an outer wall of the reservoir.

7. The washing machine according to claim 5, wherein:

the drainage tube comprises a third passage connected to the reservoir; and the third passage comprises a filter to filter foreign substances from wash water.

8. The washing machine according to claim 7, wherein the foreign substances filtered by the filter are discharged to the outside along with wash water discharged through the drainage valve to the outside.

9. A washing machine comprising:

a reservoir connected, at an upper portion thereof, to a water supply tube through which wash water is supplied while being connected, at a lower portion thereof, to a drainage tube through which wash water is discharged, so as to accommodate wash water; and a filter device to eliminate foreign substances from the wash water accommodated in the reservoir, wherein the filter device comprises a connection tube connected to the water supply tube so as to introduce wash water;

a main body which is elongated on one side surface of the reservoir in a longitudinal direction thereof, the main body being provided, at upper and lower portions thereof, with a first opening and a second opening;

the first opening located at the upper portion of the main body is connected to the water supply tube such that wash water is supplied through the first opening;

the second opening located at the lower portion of the main body is connected to the reservoir through a first passage and the drainage tube through a second passage;

a check valve configured to selectively open and close the first passage and the second passage; and a moving device movably installed between the first opening and the second opening, wherein the wash water accommodated in the reservoir circulates through the drainage tube and the reservoir and passes through a filter located between the drainage tube and the reservoir, according to movement of the moving device, so as to eliminate foreign substances, the moving device moves in an inner portion of the main body by pressure of wash water supplied through the connection tube and pressure of wash water filling the reservoir, when the moving device is moved downward by pressure of the wash water supplied through the water supply tube, the check valve opens the second passage and closes the first passage, and when the moving device is moved up, the check valve opens the first passage and closes the second passage.

10. The washing machine according to claim 9, wherein:

the water supply tube comprises the connection tube through which wash water is discharged to the first opening and a water supply valve through which wash water is introduced into the reservoir or blocked from being introduced into the reservoir; and the connection tube and the water supply valve are sequentially arranged in an introduction direction of wash water such that wash water is capable of being introduced into only the connection tube and the moving device is capable of dropping when the water supply valve is closed.

11. The washing machine according to claim 9, wherein the check valve is installed such that wash water is capable of being introduced into the main body by opening the first passage using pressure of wash water filling the reservoir and the wash water introduced into the main body is capable of being discharged through the second passage.

12. The washing machine according to claim 11, wherein:

the drainage tube comprises a drainage valve through which wash water is discharged to the outside or is blocked from being discharged to the outside;

the filter is configured such that foreign substances contained in wash water, which is discharged through the second passage and introduced into the drainage tube, remain in the drainage tube while the wash water passes through the filter; and the foreign substances remaining in the drainage tube are discharged to the outside along with wash water discharged to the outside by opening of the drainage valve.

13. The washing machine according to claim 9, wherein the moving device comprises an elastic portion which is contractible and expandable by water pressure.

* * * * *